United States Patent [19]

Fegley et al.

[11] 4,055,277

[45] * Oct. 25, 1977

[54] FLUID DISPENSING ANTI-BURGLARY DEVICE

[76] Inventors: Charles R. Fegley, 1606 Frush Valley Road, Laureldale, Pa. 19605; Anderson F. Johnson, Jr., 535 Grings Hill Road, Sinking Spring, Pa. 19608

[ * ] Notice: The portion of the term of this patent subsequent to Apr. 23, 1991, has been disclaimed.

[21] Appl. No.: 668,275

[22] Filed: Mar. 18, 1976

[51] Int. Cl.[2] ..... B65D 83/14

[52] U.S. Cl. ..... 222/5; 222/180

[58] Field of Search ..... 222/402.11, 402.14, 222/3, 5, 39, 81, 83, 182, 173, 180, 509; 239/274; 194/97; 116/6, 15, 76, 87

[56] References Cited

U.S. PATENT DOCUMENTS

| | | | |
|---|---|---|---|
| 2,866,472 | 12/1958 | Risely | 222/180 X |
| 3,757,371 | 9/1973 | Martin | 222/5 X |
| 3,806,000 | 4/1974 | Fegley | 222/402.14 X |

*Primary Examiner*—Stanley H. Tollberg

[57] ABSTRACT

A fluid dispensing anti-burglar device is disclosed from which a pressurized fluid such as tear gas is discharged, when an unauthorized movement of an object is attempted. The anti-burglar device employs a security cable which will permit limited movement of the object but will cause the release of the pressurized fluid when the security cable is severed or removed from its terminations.

11 Claims, 12 Drawing Figures

FLUID DISPENSING ANTI-BURGLARY DEVICE

BACKGROUND OF THE INVENTION

The invention relates generally to an anti-burglary device and more particularly to an object projecting anti-burglary device which dispenses a fluid such as tear gas from a pressurized container into the area surrounding the object being protected by the device. Severing or disconnecting a security cable, which attaches an object such as a televison set, Hi Fi equipment, etc. to an immobable structure such as a column or wall of a building,, will actuate the device and cause the area surrounding the object to be flooded with the fluid thereby forcing abandonment of the object and evacuation of the area. However, the security cable is constructed in a manner to permit limited movement of the object without actuating the device. The invention may utilize any type of pressurized container.

Chemical weapons have been known in the art for many year; one type of chemical weapon is the conventional tear gas grenade in which the firing member is generally triggered manually and the grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A thrid type of chemical anti-burglary device discharges an explosive tear gas shell into the area but this type is both dangerous and very limited as to the amount of tear gas which is discharged into the area being protected.

Thus what is needed is a device, which can be utilized to protect various types of objects in the form of an actuatable fluid dispenser for use with a security cable. If the security cable, which attaches the object to an immovable object, is severed or disconnected, a spring means is released to force the fluid dispensing element of the pressurized container into engagement with a dispensing element-actuating means which actuates the dispensing element and thereby releases the fluid.

SUMMARY OF THE INVENTION

The principle object of the present invention is to provide an anti-burglary device of the fluid dispensing type which will be actuated by the severance or disconnection of an associated security cable which secures the device from accidental release.

Another object of the invention is to provide an improved means for spraying or discharging a fluid into the protected area in a minimum amount of time in order to force the burglar from the area and to prevent that person from re-entering that immediate area for a reasonable amount of time.

Another object of the present invention is to provide a directable emission of the fluid such as by means of a separate or integral dispensing head. Tampering with or severing the security cable will actuate the device and the dispensing head will then direct the fluid into the area where the object being protected is located.

According to the principle aspect of the present invention there is provided first an improved means for securing an object being protected to a larger immovable structure such as a building, wall or column. The security cable is a coaxially structured cable having an outer sheath of a material difficult to cut and a slidably contained core member made of a non-stretching material also resistant to pinch-off or severing. A means for attaching the cable to a wall or column or other immovable object is provided, while releasably retaining to the cable center member to keep the device in a retained, yet actuatable condition. The security cable constructed in this manner provides a means for limited movement of a movable object without causing discharge.

Other objects, aspects and advantages of the invention will become apparent from the following description taken in connection with the accompanying drawings.

DESCRIPTION OF THE PREFERRED EMBODIMENTS

Figure 1:
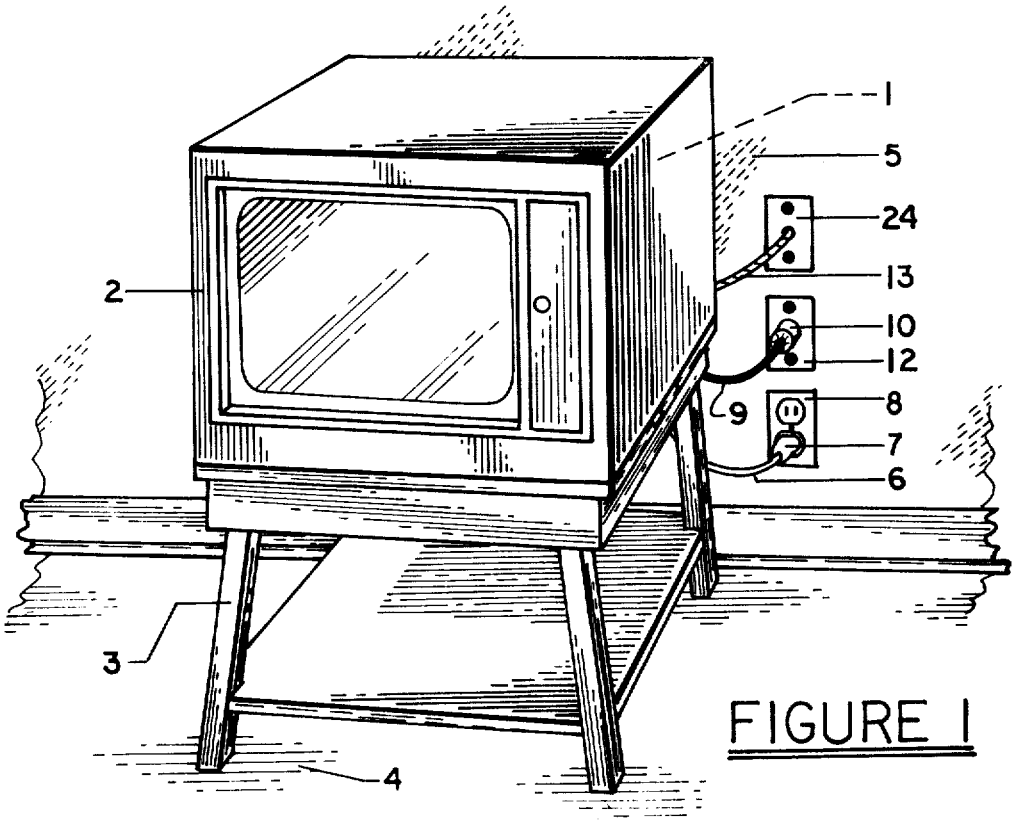
FIG. 1 is an elevational view showing one type of installation wherein the security cable is installed between a televison set and a wall.
Figure 2:
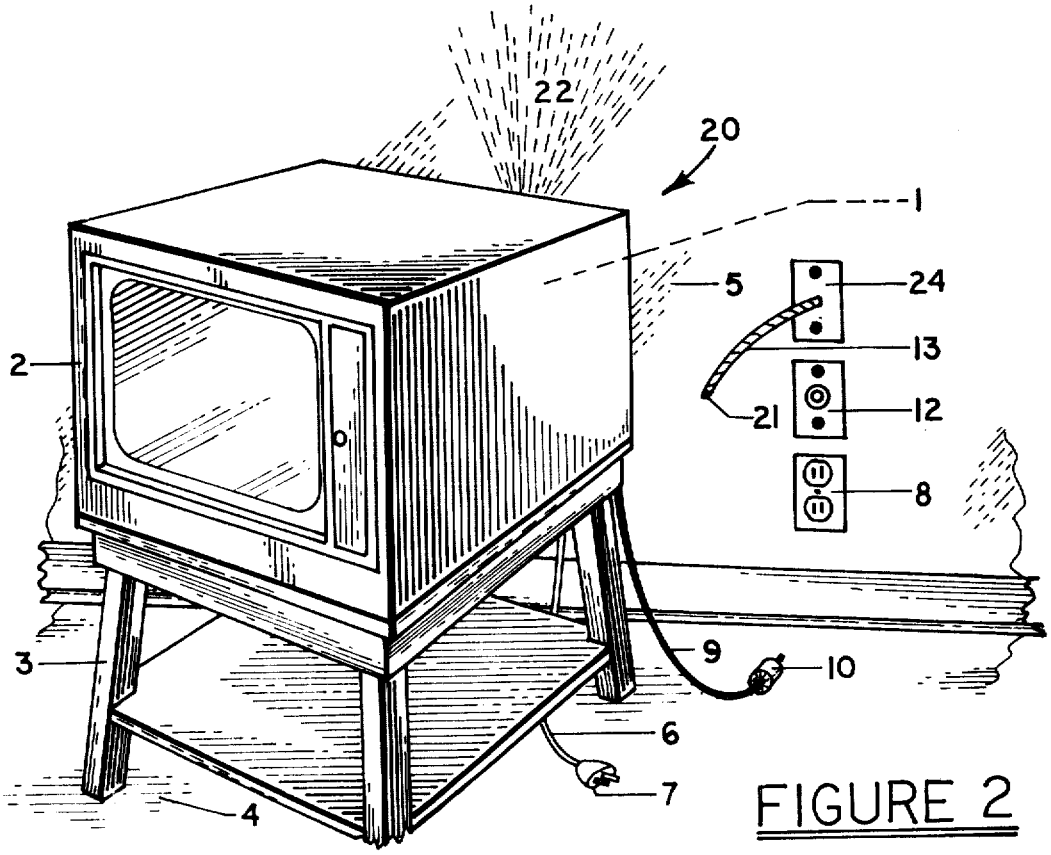
FIG. 2 is a view similar to FIG. 1 but showing the security cable severed and the device dispensing fluid.

Referring now to the drawings in detail, wherein like reference characters designate like parts throughout the various views, there is shown in FIGS. 1–6 one form of the anti-burglar fluid dispensing device, called device hereafter, of the chemical weapon type according to the present invention generally designated 1. In FIGS. 1 and 2, the device 1 is shown for convenience as being contained within a movable object such as a television receiver 2 which is shown positioned on the television receiver table 3 resting on floor 4. In FIG. 1, the secured operation, the television receiver 2 is attached and secured to an immovable object, shown for convenience as a wall 5, by one type of security cable 13 attached to its security cable plate 24. The television receiver 2 may be moved within the radius permitted by the security cable 13 without causing discharge.

In FIG. 2, the television receiver 2 and its table 3 are shown moved away from wall 5 in direction 20 to initiate its attempted unauthorized removal from the area. The power and antenna cables 6 and 9 have been disconnected from receptacle 8 and jack 12, the security cable 13 has been severed 21 and the device 1 has been actuated to release a chemical fluid 22 such as tear gas into the area around the television receiver 2 causing abandomment of the attempted theft thereof.

Figure 3:
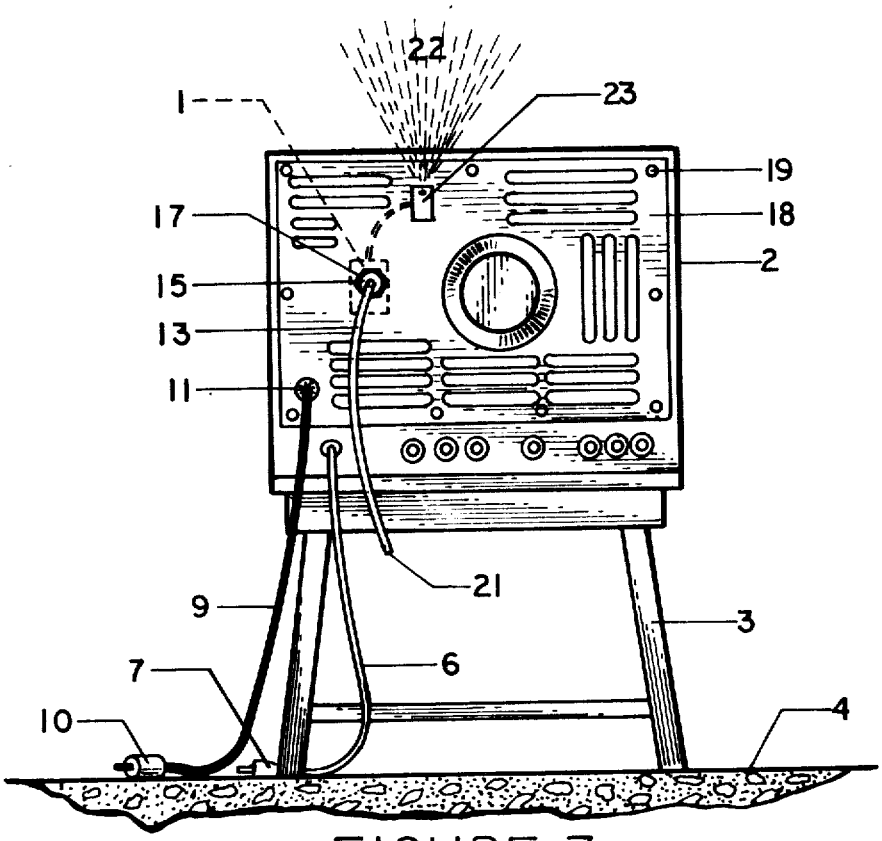
FIG. 3 is a rear view of a television set of FIGS. 1 and 2 showing one method of mounting of the anti-burglary device and its major parts.

As shown in FIG. 3, the fluid 22 is dispensed into the area from the dispensing head 23 which is part of device 1, shown mounted to the rear cover 18 of the television receiver 2. As best seen in FIGS. 3, 4, 5 and 6, the device 1 is mounted on the rear cover 18 and the device 1 is connected to the security cable 13 through the use of a cable mounting fitting, hereafter referred to as fitting 16, and mounting nut 17 which hold the device's body member 30 against the rear cover 18 by utilizing the rear cover's device mounting hole 44.

Figure 4:
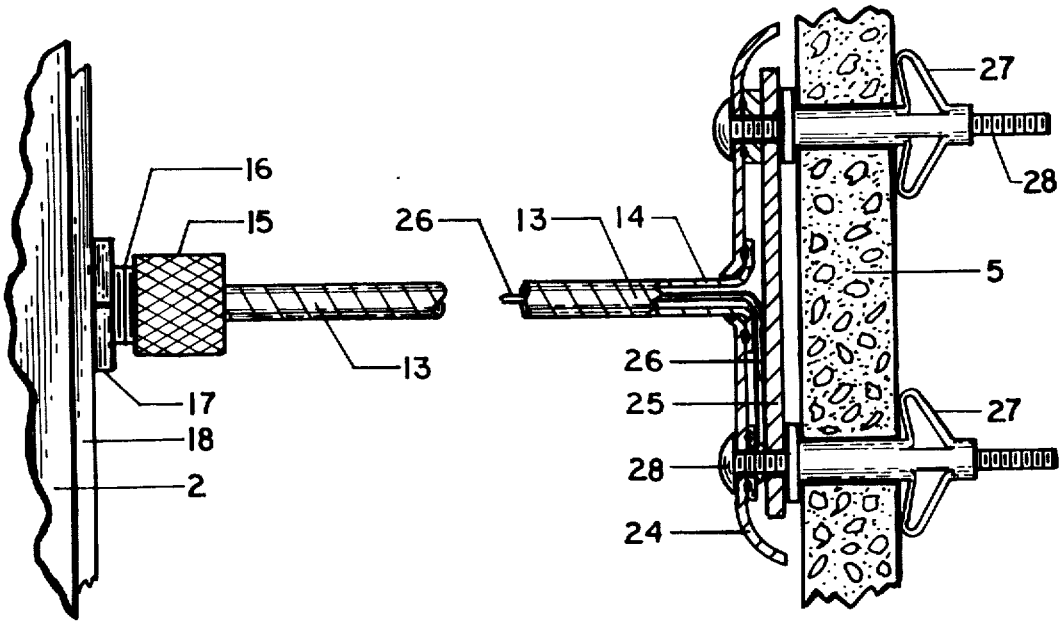
FIG. 4 is an enlarged view showing one type of security cable and its connections to the back cover panel of the television set and a wall.

One type of security cable 13 is shown in FIG. 4 as being comprised of a security cable sheath 14 and core 26, which normally keeps the device 1 in a non-actuated condition and is attached to fitting 16, while the means for fastening the security cable 13 at the other end is shown as having the cable sheath 14 and core 26 attached to a plate 24. A means for attaching the security cable 13 at the end opposite the device 1 consists of the security cable plate 24 to which the flared end of the cable sheath 14 is attached, a clamping plate 25, two fasteners 27 and mounting screws 28 which fasten the plate 24 and clamping plate 25 to wall 5. The cable sheath 14 as attached to plate 24 and to fitting 16 is semi-rigid allowing the cable core 26 to be placed in tension holding the device 1 in a actuatable condition. This is accomplished by tensioning the core 26 and clamping the end between the cover plate 24 and clamping plate 25 and then attaching the plates and cable core 26 to the wall 5 using the fasteners 27 and mounting screws 2 thereby keeping the cable core 26 under tension.

Figure 5:
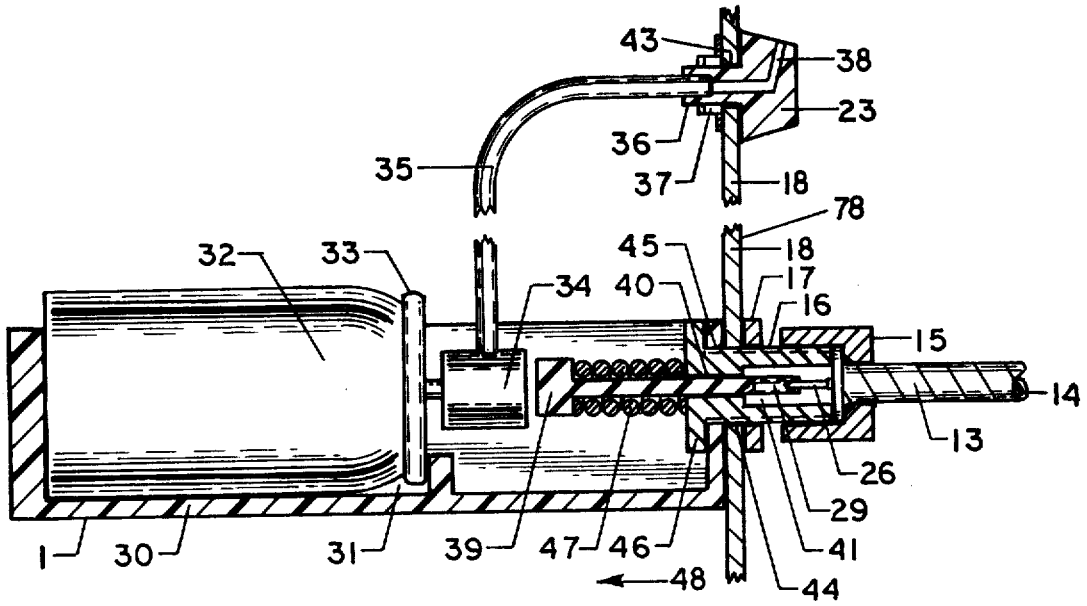
FIG. 5 is a vertical cross-sectional view of the device showing the device in its ready to actuate condition wherein the device contains a pressurized container having a projecting dispensing spout.

Now referring to FIG. 5, the device end of the cable core 26 is attached to the dispensing element actuating means, one form of which is the spring 47 biased actuating member 29 located in the fitting 16 connection cavity 41 and secured by cable core 26 loop clamp 42 to complete the tensioning of cable core 26. The core 26 must be sufficiently strong to maintain tension on the wall plate 24 and actuating member 29 to keep spring 47 compressed, the cable sheath 14 being rigid enough to withstand the compressive forces upon the cable sheath 14 caused by the tension of cable core 26 upon the security cable connections as caused by the compression of spring 47. The tensioned core 26 therefore keeps the device 1 in a nonactuated condition until such time that the security cable 13 is severed 21 or tampered with in some way to cause a release or disconnection of core 26. It is important that the cable sheath 14 be made to withstand forces in compression while the cable core 26 withstand forces in tension. The assembly should provide a cable 13 which is flexible in a direction radially from the axis to provide for limited movement of the objects being protected without causing discharge.

Figure 6:
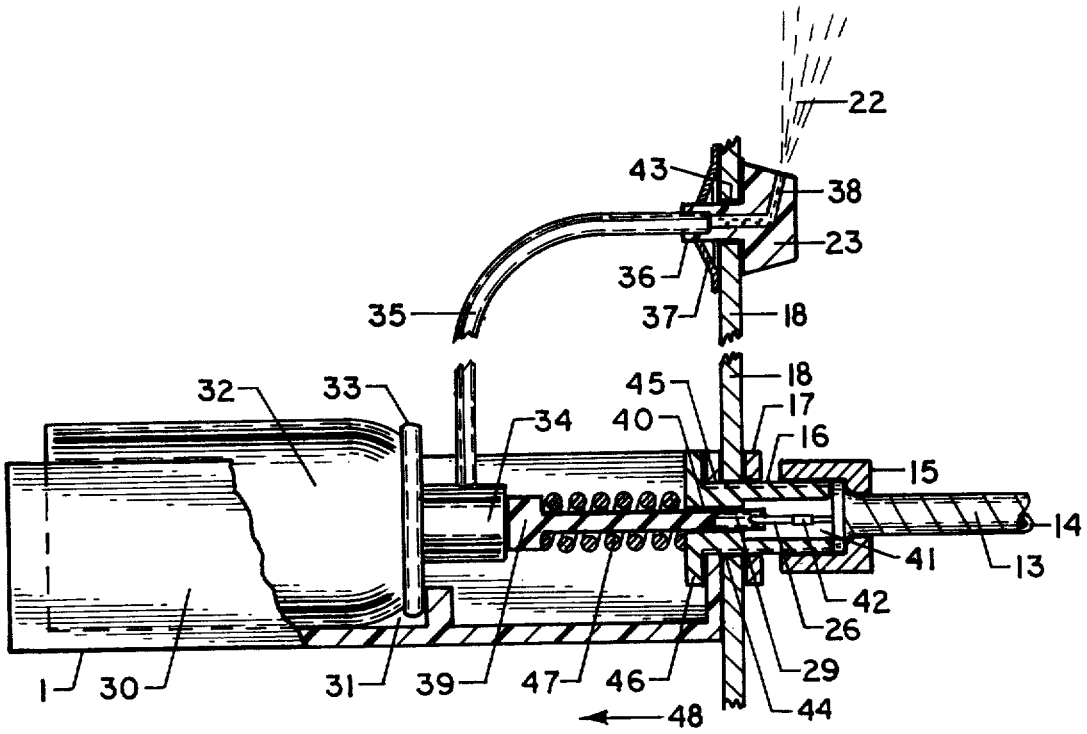
FIG. 6 is a vertical cross-sectional view similar to FIG. 5 but showing the device actuated and dispensing fluid.

The preferred embodiment of the device 1 is illustrated in FIGS. 5 and 6. the device mounting and cable fitting 16 secures the body member 30 of the device 1 to a mounting plate 78, shown for convenience as the rear cover 18, with mounting nut 17. The sheath 14 of security cable 13 is also attached to fitting 16 by security cable flare nut 15. The pressurized fluid container 32 is shown contained in the container cavity 31 of body member 30. Also shown in FIGS. 5 and 6 are the other elements of the device such as the fluid dispensing element comprising of a projecting dispensing cap 34, dispensing cap extension tube 35 and device dispensing head 23. The dispensing head 23 is mounted on the outer side of the mounting plate 78 by the dispensing head's mounting projection 36 passing through hole 43 in mounting plate 78 and being secured by the retainer 37 pressed onto projection 36 and against mounting plate 78. The mounting projection 36 is also a connection for the container dispensing cap's extension tube 35, which leads to the fluid passageway 38 in device dispensing head 23. The fluid passageway 38 may have a non-symetrical shaped cross-section which cannot be readily plugged by a burgler to prevent dispensing of the fluid 22 when the device 1 is actuated; however, if plugged, the pressure of the fluid 22 from the pressurized fluid container 32 is sufficient to pop the light press fit connection of the projecting dispensing caps extension tube 35 from the device dispensing head projection 36 to allow the dispensing of fluid to continue, the dispensed fluid vapors being able to escape. The location of device 1 and its dispensing head 23 can vary, being limited only by the effective length of extension tube 35 which should be kept as short as possible for maximum device effectiveness.

Now referring to FIGS. 2, 3 and 6 illustrating the device in its security cable severed, actuated and fluid dispensing condition, the functions of the actuating member 29 and projecting dispensing cap 34 can be described. When the security cable 13 is severed as shown in FIGS. 2 and 3 where both the cable sheath 14 and core 26 are severed, or if the center member 26 is released from its tensioned state by disassembly of the wall connection 24, the spring 47 moves the actuating member 29 in the direction 48 to push on dispensing cap 34 of the pressurized fluid container 32 with its head 39 to cause discharge of the container's contents, as best viewed in FIG. 6. The dispensing cap 34 of the pressurized container 32 when depressed by the actuating member head 39 causes the discharge of its chemical fluid 22 through the dispensing cap 34, the extension tube 35 and through the shaped fluid passageway 38 of the device dispensing head 23 to dispense the fluid 22 into the area around the television receiver or other equipment being protected to force abandonment of the attempted burglary by the perpetrator thereof.

The device 1 can be returned to its original, usable and actuatable condition after having been actuated by replacing or disconnecting the security cable 13 and its core 26 to again place the actuating member 29 in a cocked position. Replacement of the pressurized fluid container 32 in the container cavity 31 by disconnecting the extension tube 35 from the original dispensing cap 34 and connected to the new container 32.

Figure 9:
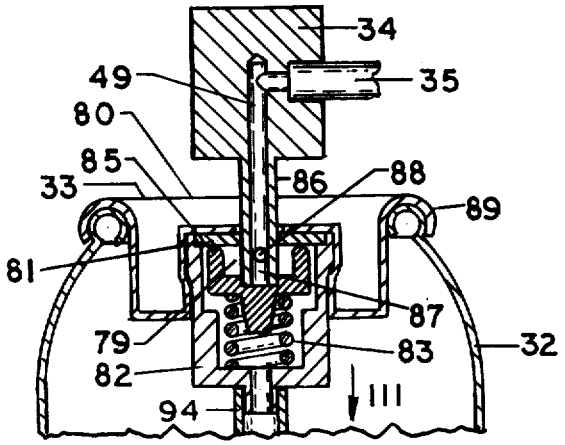
FIG. 9 is a partial vertical section showing a valve for use with a pressurized container having a projecting dispensing cap.

One type of pressurized container 32, shown as having a fluid-dispensing element in the form of a projecting dispensing cap 34, for use in this embodiment is shown in FIG. 9 as containing a valve assembly generally designated 80. Valve assemblies of this type are well known in the trade and one tyype of which is sold by Scovill, Manchester, N.H. as their S-63 valve assembly. The valve assembly 80 is shown as being comprised of a projecting dispension cap 34 which contains generally a passageway 49 and is closed at one end 87 thereof. A valve seat 85 is formed around the sealed end 87 of the passageway 49 and contains a recessed portion 79 formed to provide a fluid passageway which will permit fluid flow to a discharge hole 88 and gives fluid access to the passageway 49. The valve seat extension 86 is slidably mounted in spring cup 82 and is urged by spring 83 toward the valve seal 81. In this position, the valve seat 85 forms a seal with the valve seal 81. A dip tube 84 may be attached to the spring cup 82 to provide access to fluid when in liquid form in the container 32. The assembly is generally mounted in a metal cup 89 which is then fastened to the container 32.

When the projecting dispensing cap 34 is moved in direction 111, the valve seat 85 is separated from the valve seal 81, thereby permitting fluid under pressure to flow up dip tube 84, around valve seat 85, through discharge hole 88 and out the passageway 49.

It is important in this embodiment that the fluid-dispensing element comprises of a projecting dispensing cap 34 which when depressed causes fluid discharge therethrough. A dispensing element actuating means is provided by plunger 39 which will depress the dispensing cap 34 when the plunger 39 is moved toward it and thereby cause fluid discharge.

Figure 7:
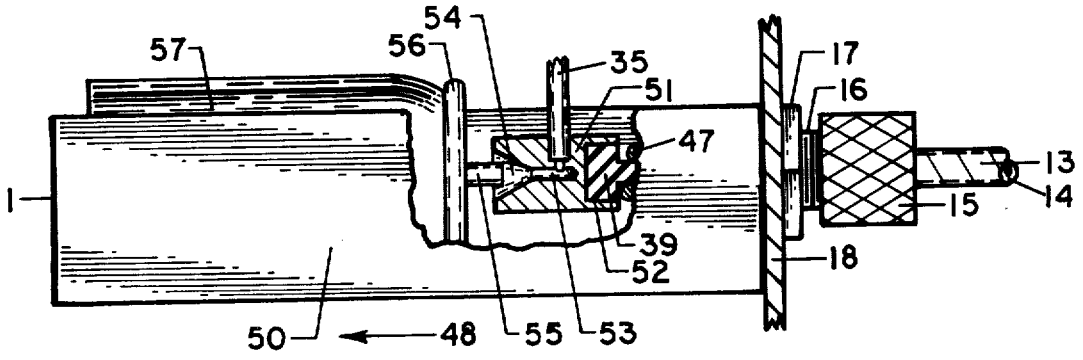
FIG. 7 is a partial vertical cross-sectional view similar to FIG. 5 but showing a second embodiment of the device utilizing pressurized fluid container having a projecting dispensing spout.

A second embodiment of the invention is illustrated in FIG. 7; the basic structure is as previously described and like numbers are used to indicate like or corresponding parts.

In this second embodiment, the pressurized fluid container 32 having a projecting dispensing cap 34 is replaced by a pressurized fluid container 57 having a projecting dispensing spout 55. The projecting dispensing cap 34 is replaced by a discharging element 51 which has a fluid passageway 53 and fluid passageway entry section 54 and which is mounted coaxial with the projecting dispensing spout 55 and is mounted directly upon the actuating member head 39 contained in discharging element cavity 52.

In this embodiment, all elements function as described in the first embodiment with the following difference. The actuating member 39 moving in direction 48 upon removal of the tension of security cable core 26 moves the mounted discharging element 51 in direction 48 so that the funnel shaped entry section 54 of the fluid passageway 53 which is coaxially aligned with the projecting dispensing spout 55 to come in contact with, form a fluid seal with and push the projecting dispensing spout 55 to cause the discharge of the fluid 22 of the pressurized fluid container 57 through the fluid passageway 53, extension tube 35 and dispensing head 23 into the area around the equipment being protected.

Figure 10:
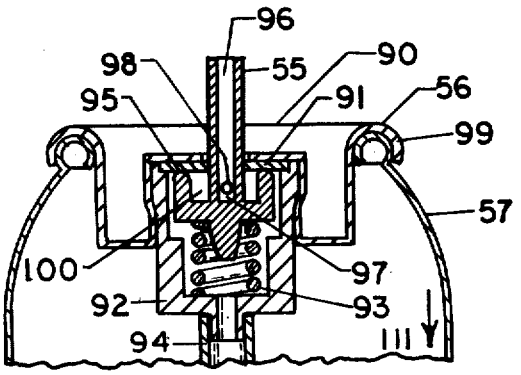
FIG. 10 is a partial vertical section showing a valve for use with the pressurized container having a projecting dispensing spout.

One type of pressurized container 57, shown as having a fluid-dispensing element in the form of a projecting dispensing spout 55, for use in this embodiment is shown in FIG. 10 as containing a valve assembly generally designated 90. Valve assemblies of this type are well known in the trade and one type of which is sold by Scovill, Manchester, N.H. as their S-63 valve assembly. The valve assembly 90 is shown as being comprised of a projecting dispensing spout 55 which has generally a hollow tube portion 96 and is closed at one end 97 thereof. A valve seat 95 is formed around the sealed end 97 of the dispensing spout 55 and contains a recessed portion 100 formed to provide a fluid passageway which will permit fluid flow to a discharge hole 98 and gives fluid access to the hollow tube 96. The dispensing spout 55 is slidably mounted in spring cup 92 and is urged by spring 93 toward the valve seal 91. In this position, the valve seat 95 forms a seal with the valve seal 91. A dip tube 94 may be attached to the spring cup 92 to provide access to fluid when in liquid form in the bottom of the container 57. The assembly is generally mounted in a metal cup 99 which is then fastened to the container 57.

When the projecting dispensing spout 55 is moved in direction 111, the valve seat 95 is separated from the valve seal 91 thereby, permitting fluid under pressure to flow up dip tube 94, around the valve seat 95, through the discharge hole 98 and out the hollow tube 96.

It is also important in this embodiment that the fluid-dispensing element comprises of a dispensing valve 90 having a projecting dispensing spout 55 which when depressed causes fluid discharge therethrough. The fluid passageway 53 contains the fluid dispensing-actuating means in the form of a funnel shaped entry section 54 which engages the projecting dispensing spout 55 and forms a seal between the entry section 54 of passageway 53 and the projecting dispensing spout 55.

Figure 8:
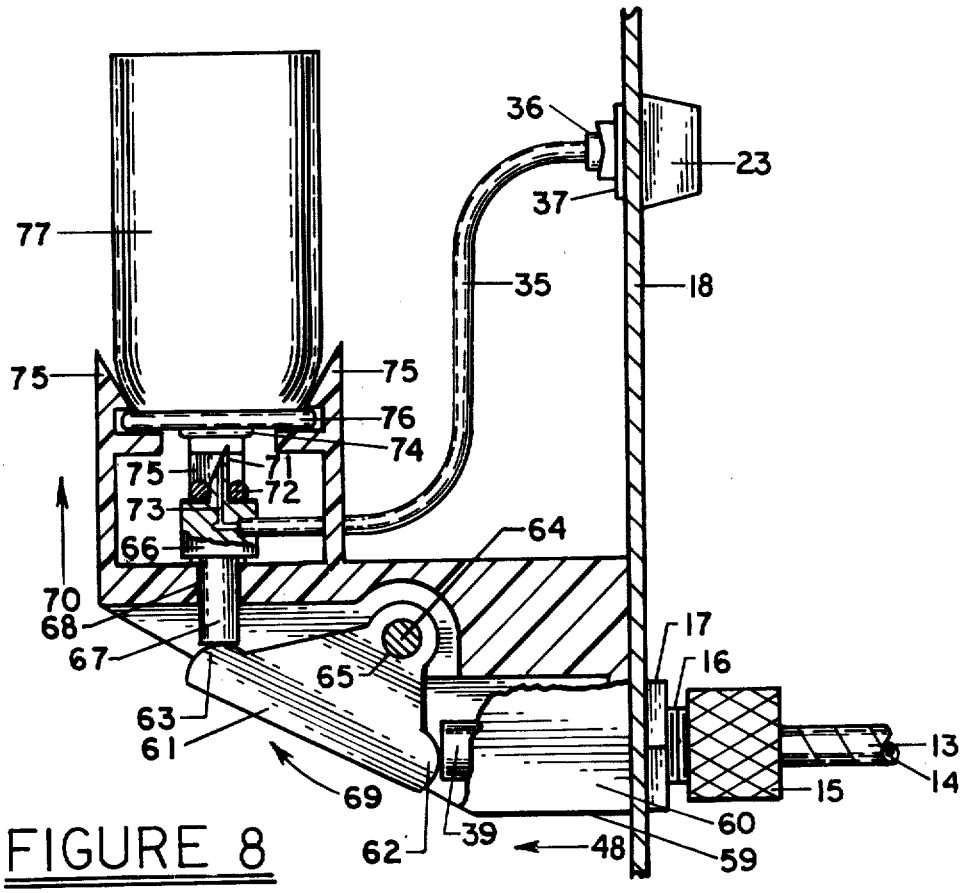
FIG. 8 is a vertical cross-sectional view similar to FIG. 5 but showing a third embodiment of the device to utilize a pressurized container having a pierceable seal.

A third embodiment of the invention is illustrated in FIG. 8; the basic structure being modified for a different type of pressurized fluid container but all parts contained in previously described embodiments having like numbers to indicate like or corresponding parts.

In this third embodiment, the device 1 having body member 30 is replaced by the device 59 having body member 60. The container 32 is replaced by a container 77 having a puncturable seal 74. The body member container cavity 31 is replaced by container mounting arms 75 which secure the container 77 by its top rim 76 to the body member 60 in a inverted position. In this embodiment there are additional elements required to effect discharge of the container not required in prior embodiments, the first being a separate container discharge element 66 which is slidably mounted in the body member 60 and which serves upon actuation to discharge the chemical fluid 22 contents of pressurized fluid container 77 through the extension tube 35 and device dispensing head 23 just as in the prior embodiments.

In this embodiment, upon actuation of the device 59 to release actuating member 39 in direction 48 as described in the prior embodiments, the actuating member head 39 moves actuating element 61 in direction 69 about the actuating element pivot and mounting pin 64 in body member 60 which passes through pivot 64 and mounting pin hole 65 of the actuating element 61. As the actuating member 39 moves the actuating element 61 by pushing on the actuator cam portion 62 of the actuating element 61 which in turn transmits the movement in direction 69 to the discharge element cam portion 63 to move the discharge element shaft 67 of the discharge element 66 in direction 70 to act upon and discharge the pressurized fluid container 77. The discharge element 66 when moved in direction 70 upon actuation by actuating element 61 cam 63 moves its piercing point 71 to pierce the piercable seal 74 of container 77. The discharge element 66 will be moved in direction 70 until the O-ring seal 72 is squeezed between the discharge element 66 and piercable container seal 74 to form a sealed fluid passage causing the fluid 22 to flow from the container 77 through the piercing point 71 and its fluid passageway 33 into discharge element extension tube 35 and device dispensing head 23 to discharge the container 77 contents as previously described.

The third embodiment, once actuated, can be refurbished as the previous embodiments.

Figure 11:
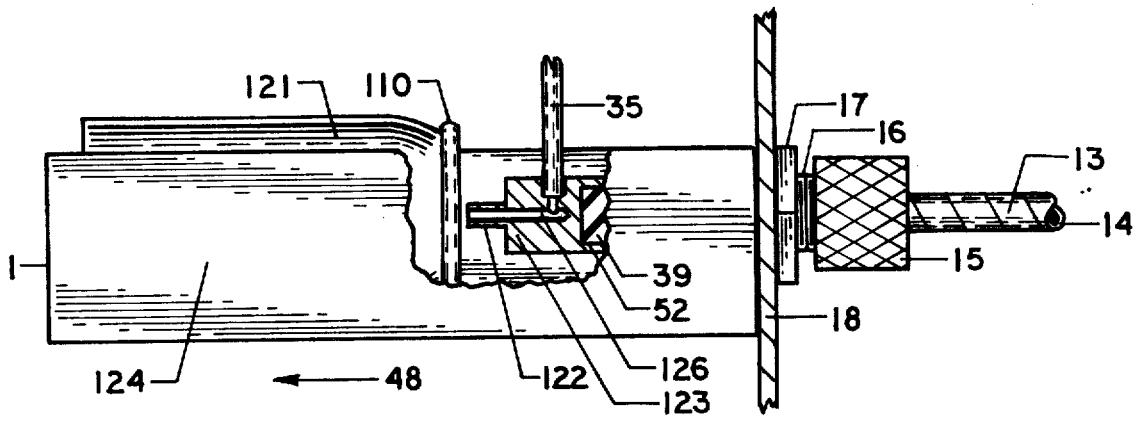
FIG. 11 is a partial vertical cross-section view similar to FIG. 7 but showing a fourth embodiment of the device utilizing a pressurized container having a recessed valve.

A fourth embodiment of the invention is illustrated in FIG. 11. In this embodiment the basic structure is as previously described and like numbers are used to indicate like or corresponding parts.

In this embodiment, the pressurized fluid container 57, shown in FIG. 7 having a projecting dispensing spout 55, is replaced with a pressurized fluid container 121, shown in FIG. 11, having a recessed valve. Pressurized containers with a recessed dispensing valve are well known in the trade. In addition, the funnel shape of the entry section 54 of the fluid passageway 53 of the second embodiment shown in FIG. 7 is replaced with projecting spout 122 depending from dispensing head 123, all of which are shown in FIG. 11.

In this embodiment, all elements function as described in the second embodiment with the following difference. The pressurized container 121 is discharged by the action of spring 47 moving the dispensing head 123 such that the recessed valve of the pressurized container 121 is depressed through engagement with projecting spout 122 and thereby effects discharge.

Figure 12:
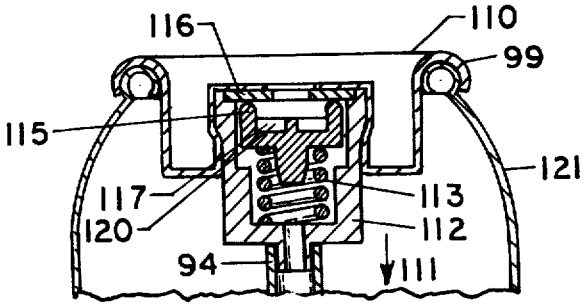
FIG. 12 is a partial vertical section showing a valve for use with a pressurized container having a recessed valve.

One type of recessed valve for use in this embodiment is shown in FIG. 12 and is generally designated 110. Valve assemblies of this type are well known in the trade and one type of which is sold by Scovill, Manchester, N.H. The valve assembly 110 is shown as being comprised of a valve seat 115 mounted in a spring cup 112. The valve seat 115 contains a recessed portion 120 and recessed channels 117 formed in valve seat 115.

The valve seat 115 is slidably mounted in spring cup 112 and is urged by spring 113 toward valve seal 116. In this position, the valve seat 115 forms a seal with the valve seal 116. The valve assembly 110 is generally mounted in a metal cup 99 which is then fastened to the pressurized container 121.

When the device 124 is actuated, the valve assembly 110 is depressed by the projecting spout 122 of the dispensing head 123. As movement continues, the projection spout 122 of the dispensing head 123 engages with and moves the valve seat 115 from engagement with valve seal 116 permitting fluid under pressure to flow around the valve seat 115, through the discharge channels 117 and out passageway 125. When the projecting spout 122 entered the valve assembly 110, the valve seal 116, being made of resilient material, formed a seal between the circumference of the projecting spout 122 and the valve seal 116, thus preventing fluid leakage.

The fluid 22 is then discharged through the valve 110 of the pressurized container 121, through the entry section 126 and passageway 125 and out the dispensing head 23, then into the area to be protected.

It is important in this embodiment that the fluid-dispensing element comprises of a recessed valve assembly 110 which when depressed causes fluid discharge. It is also important that the entry section 126 of passageway 125 contain a fluid dispensing element-actuating means in the form of a projecting spout 122 which engages with the recessed valve assembly 110 and causes fluid discharge.

Although we have herein shown and described the invention in what we have conceived to be the most practical and preferred embodiments, it is recognized that departure may be made therefrom within the scope of our invention, which is not to be limited to the details disclosed herein, but is to be accorded the full scope of the claims so as to embrace any and all equivalent structures and devices.

We claim

1. A fluid dispensing anti-burglar device, the device comprising:

a. A body member having means for mounting said device;

b. a pressurized container having a fluid-dispensing element adapted to release fluid under pressure from said pressurized container when actuated;

c. means for supporting said pressurized container in said body member;

d. a passageway for directing the fluid discharge after release;

e. dispensing element actuating means mounted in said body member and adapted to engage and actuate said fluid-dispensing element;

f. spring means biased to force said fluid-dispensing element and said dispensing element actuating means into engagement with each other thereby causing said fluid-dispensing element to be actuated;

g. a security cable comprising, a means for fastening said security cable to an object at one end thereof and to said dispensing element actuating means on the other end thereof, said dispensing element actuating means mounted for movement between a non-acutation position and a release position, said security cable holding said dispensing element actuating means in said non-actuating position and adapted to releasably retain said dispensing element actuating means in a cocked position in which said fluid-dispensing element and said dispensing element actuating means are separated from each other, said dispensing element actuating means to move to said release position when said security cable is severed with whereby said spring means is released from its cocked position causing said fluid-dispensing element to be actuated, and fluid is released from said pressurized container to pass through said passageway.

2. The fluid dispensing anti-burglar device of claim 1 in which said fluid-dispensing element of the pressurized container comprises a pierceable section, means to provide a seal beteen said pierceable section and said entry section, and mens for puncturing said pierceable section, whereby fluid may be discharged.

3. The fluid dispensing anti-burglar device of claim 2 in which said means for puncturing comprises a projecting spout depending from said body member.

4. The fluid dispensing anti-burglar device of claim 1 wherein said fluid-dispensing element of said pressurized container includes a dispensing valve actuated to permit fluid discharge therethrough upon depression thereof, said valve being actuated to said release position through movement caused by the release of said spring means whereby the valve is depressed and fluid is discharged.

5. The fluid dispensing anti-burglar device of claim 4 wherein said valved pressurized container contains a projecting dispensing spout, said dispensing spout discharging fluid upon depression thereof, said entry section of said passageway being funnel shaped for receiving said projecting dispensing spout on said container.

6. The fluid dispensing anti-burglar device of claim 4 wherein said valved pressurized container includes a recessed valve, said body member includes a projection around said entry section extending beyond said entry section toward said container to engage said recessed valve, said recessed valve actuated upon depression thereof to emit fluid.

7. The fluid dispensing anti-burglar device of claim 4 wherein said valved pressurized container contains a projecting dispensing cap actuated to permit fluid discharge therethrough upon depression thereof, an aperture in said body member in communication with said cap, said spring means arranged to actuate said dispensing cap upon release thereby discharging said pressurized container through said cap and aperture when said spring means is released.

8. The fluid dispensing anti-burgler device of claim 1 wherein the spring means comprises a spring biased actuating member arranged to actuate said fluid-dispensing element after release.

9. The fluid dispensing anti-burglar device of claim 1 wherein said security cable comprises of an outer sheath and a slidably contained core, said core to be slidably mounted within the outer sheath.

10. The fluid dispensing anti-burgler device of claim 1 wherein said security cable comprises of an outer sheath, a slidably contained core, a means for attaching said security cable to a moveable object, and a means for attaching said security cable to an immovable object wherein said security cable releasably retains said dispensing element actuating means in a non-actuation position.

11. A fluid dispensing anti-burglar device for use with a movable object, the device comprising:

a. a body member having means for mounting said device in said movable object;

b. a pressurized container having a fluid-dispensing element adapted to release fluid under pressure from said pressurized container when actuated;

c. means for supporting said pressurized container in said body member;

d. a passageway for directing the fluid discharge after release;

e. dispensing element actuating means mounted in said body member and adapted to engage and actuate said fluid-dispensing element;

f. spring means biased to force said fluid-dispensing element and said dispensing element actuating means into engagement with each other thereby causing said fluid-dispensing element to be actuated;

g. a security cable comprising, a means for fastening said security cable to an unmovable object at one end thereof and to said dispensing element actuating means associated with a movable object on the other end thereof, said dispensing element actuating means mounted for movement between a non-actuation position and a release position, said security cable holding said dispensing element actuating means in said non-actuating position and adapted to releasably retain said dispensing element actuating means in a cocked position in which said fluid-dispensing element and said dispensing element actuating means are separatd from each other, said dispensing element actuating means to move to said release position when said security cable is severed with whereby said spring means is released from its cocked position causing said fluid-dispensing element to be actuated, and fluid is released from said pressurized container to pass through said passageway.

* * * * *